US006228508B1

(12) United States Patent
Kassanits et al.

(10) Patent No.: US 6,228,508 B1
(45) Date of Patent: May 8, 2001

(54) PROCESS FOR PREPARING A METAL BODY HAVING A HERMETIC SEAL

(75) Inventors: Richard Kassanits, West Chicago; Timothy H. Hennessy, Plainfield, both of IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/498,673

(22) Filed: Feb. 7, 2000

(51) Int. Cl.[7] ..... B22F 7/02

(52) U.S. Cl. ..... 428/547; 419/6; 419/54; 428/548

(58) Field of Search ..... 419/5, 7, 37, 6, 419/54; 428/547, 548

(56) References Cited

U.S. PATENT DOCUMENTS 4,191,654 * 3/1980 Larson ..... 210/451
4,364,783 * 12/1982 Theodore et al. ..... 156/69
4,971,755 11/1990 Kawano et al. .
5,401,292 3/1995 Japka .

* cited by examiner

*Primary Examiner*—Daniel Jenkins
(74) *Attorney, Agent, or Firm*—Leydig, Voit & Mayer, Ltd.

(57) ABSTRACT

Disclosed is a process for preparing a metal body via metal powder molding techniques. First and second component parts are conventionally injection molded from a metal powder molding material. The first ultrasonic part is molded to have an ultrasonic energy director surface, which may be, for example, a rib having a triangular cross section. In accordance with the disclosed process, the first and second component parts then are ultrasonically welded to form a green assembly, and this green assembly is debound and sintered in accordance with conventional metal powder molding techniques to form a metal body. The metal body thus formed will be hermetically sealed along the ultrasonic weld. The process of the invention thus may be employed in the preparation of metal objects that require a hermetic seal, such as fluid flow nozzles, pressure vessels, and the like.

14 Claims, 5 Drawing Sheets

21
22
25
26
27
28
31
32
33
34
37
38
39
5
6

PROCESS FOR PREPARING A METAL BODY HAVING A HERMETIC SEAL

TECHNICAL FIELD OF THE INVENTION

The invention is in the field of metal powder molding, and pertains more specifically to a method for preparing a metal body via metal powder molding techniques.

BACKGROUND OF THE INVENTION

It is known to make metal objects by means of metal powder molding techniques. In accordance with such techniques, a mixture of metal powder and a resinous binder is molded into a green body, typically by injection molding. The green body is then chemically or thermally debound, and is then sintered at a temperature near the melting temperature of the metal powder. Upon sintering of the green body, the metal powder particles fuse together to form a metal body. Numerous metal powder molding materials and techniques are known in the art, and such are exemplified in U.S. Pat. No. 5,401,292 (Japka), entitled "Carbonyl Iron Powder Premix Composition" and in U.S. Pat. No. 4,971,755 (Kawano et al.), entitled "Method for Preparing Powder Metallurgical Sintered Product."

When forming hollow metal objects using metal powder molding techniques, it is typical to mold two green halves or component parts of the metal object separately, and to then place these two component parts into contact with one another under pressure prior to debinding and sintering. One problem with known metal powder molding techniques is that it is difficult and often impossible to attain a hermetic seal between the two molded component parts in the metal body. Thus, it is not presently commercially practicable to fabricate hermetically sealed hollow metal bodies, such as pressure vessels and fluid flow nozzles, using known metal powder molding techniques. The present invention is addressed to this drawback in the metal powder molding art.

SUMMARY OF THE INVENTION

The present invention is based on the surprising discovery that a hermetic seal may be obtained between two component parts of a metal powder molded body if the parts are ultrasonically welded to one another while still in the green state. While it is not intended to limit the invention to a particular theory of operation, it is believed that the ultrasonic welding causes a more intimate mixing of the metal powder and binder materials in the component parts, such that upon sintering a more uniform and intimate metal bond is formed between the two component parts than would be obtained absent the ultrasonic welding step. This bond, it is believed, results in a hermetic seal in the metal body in the region of the ultrasonic weld.

In accordance with the invention, a process for preparing a metal body is provided. The process includes the steps of providing first and second component parts each comprising a molded metal powder material and being in the green state, the first component part having an ultrasonic energy director surface; ultrasonically welding the first component part to the second component part to form a green assembly with an ultrasonic weld along its energy director surface; debinding the green assembly; and sintering the debound green assembly to form a metal body. The metal body thus formed will be hermetically sealed along the ultrasonic weld. Preferably, the component parts have mutually-engaging bonding surfaces that further define a green bonding area upon formation of the ultrasonic weld between the component parts.

This green bonding area preferably is greater than the area of the ultrasonic weld, to thereby provide a union in the metal body that is strong relative to the union in the region of the weld. The invention also encompasses a metal body prepared in accordance with the foregoing process.

These and other features of the invention will be exemplified in the following drawings, in which:

Figure 1:
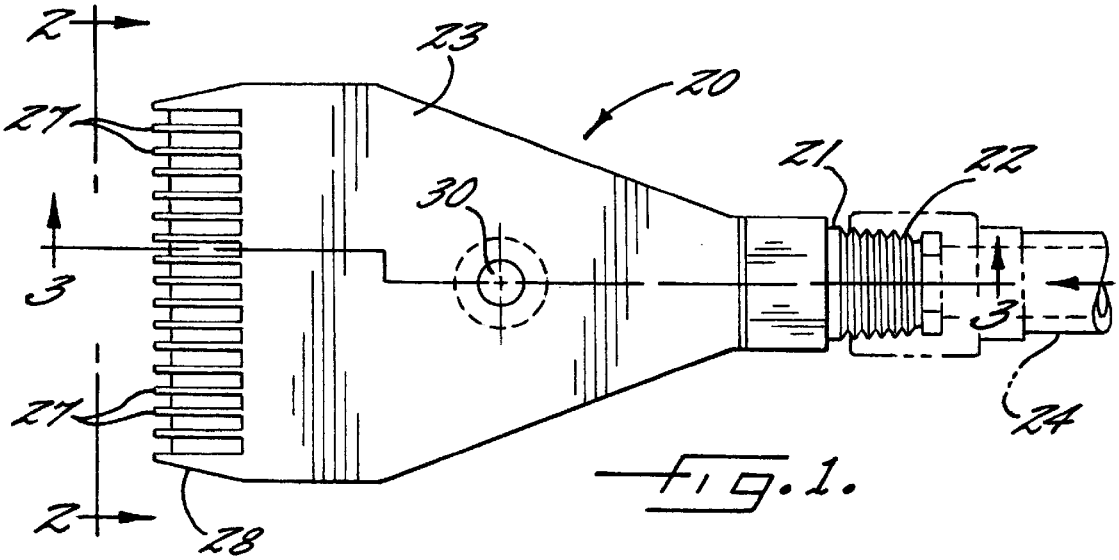
FIG. 1 is a top view of a fluid flow nozzle made in accordance with the process of the invention.

While the invention is susceptible of various modifications and alternative constructions, certain illustrated embodiments thereof have been shown in the drawings and will be described below in detail. It should be understood, however, that there is no intention to limit the invention to the specific forms disclosed. But on the contrary, the intention is to cover all modifications, alternative constructions and equivalents falling within the spirit and scope of the invention.

DESCRIPTION OF THE PREFERRED EMBODIMENTS

The present invention contemplates the preparation of metal parts using metal powder molding feedstocks. Numerous such materials are known in the art, and such materials are exemplified in the aforementioned U.S. Pat. Nos. 5,401, 292 and 4,971,755, both of which are hereby incorporated by reference. The preferred metal powder molding material is CATAMOLD® 316L, sold by BASF AG, Ludwigshaffen, Germany. Other CATAMOLD® feedstocks also are useful in conjunction with the invention. The CATAMOLD® products are substantially homogeneous mixtures of fine metal powders, typically stainless steels, bound in a polyacetal binder. In accordance with known metal powder molding techniques, the feedstock of such metal powder molding material is molded, typically by injection molding, to form a green body. suitable injecting molding conditions are disclosed in BASF publication CATAMOLD® Feedstock For Powder Infection Molding: Processing-Properties-Application, BASF Aktiengesellschaft, Sep. 19, 1997, which is hereby incorporated by reference.

Figure 2:
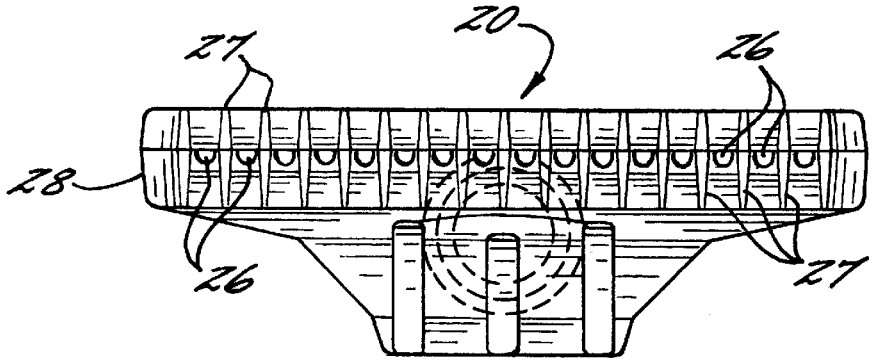
FIG. 2 is an enlarged front elevational view of the fluid flow nozzle illustrated in FIG. 1.
Figure 3:
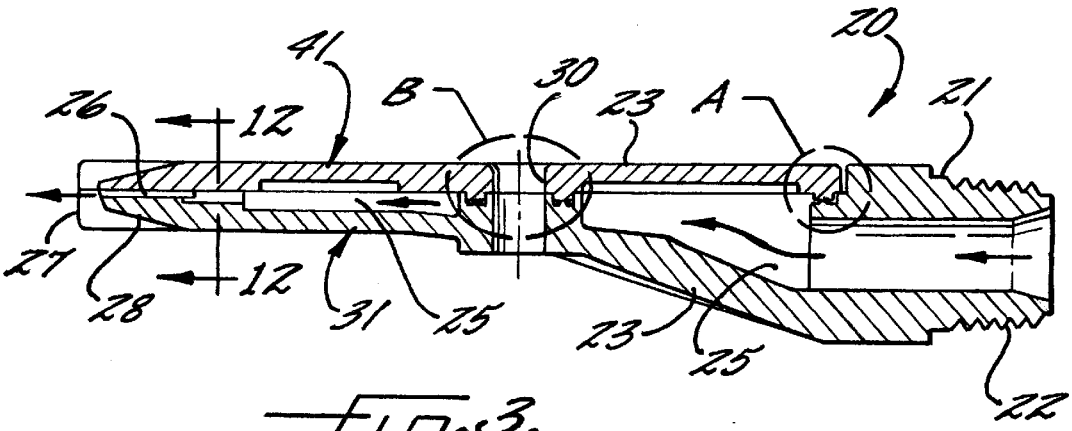
FIG. 3 is an enlarged cross-sectional view of the illustrated nozzle taken in the plane of line 3—3 in FIG. 1.

Turning now more particularly to the drawings, there is shown an illustrative air flow nozzle 20 that embodies one example of a metal body prepared in accordance with the present inventive process. With reference to FIGS. 1–3, the nozzle 20 includes an upstream end 21 having a threaded portion 22 for connection to a supply line 24 (shown in phantom in FIG. 1). The upstream end 21 defines an air inlet passage that communicates with an internal air chamber 25 (shown in FIG. 3) defined by a body portion 23 of the nozzle. The air chamber 2S fluidically communicates with a multiplicity of air outlet passages 26 (shown in FIGS. 2 and 3) disposed at the downstream end 28 of the nozzle 20. Each of the air outlet passages 26 is bounded by a pair of flow baffles 27 (best shown in FIG. 2). The nozzle 20 further includes a cylindrical mounting bore 30 that extends through the internal air chamber 25.

Figures 4, 5, 6:
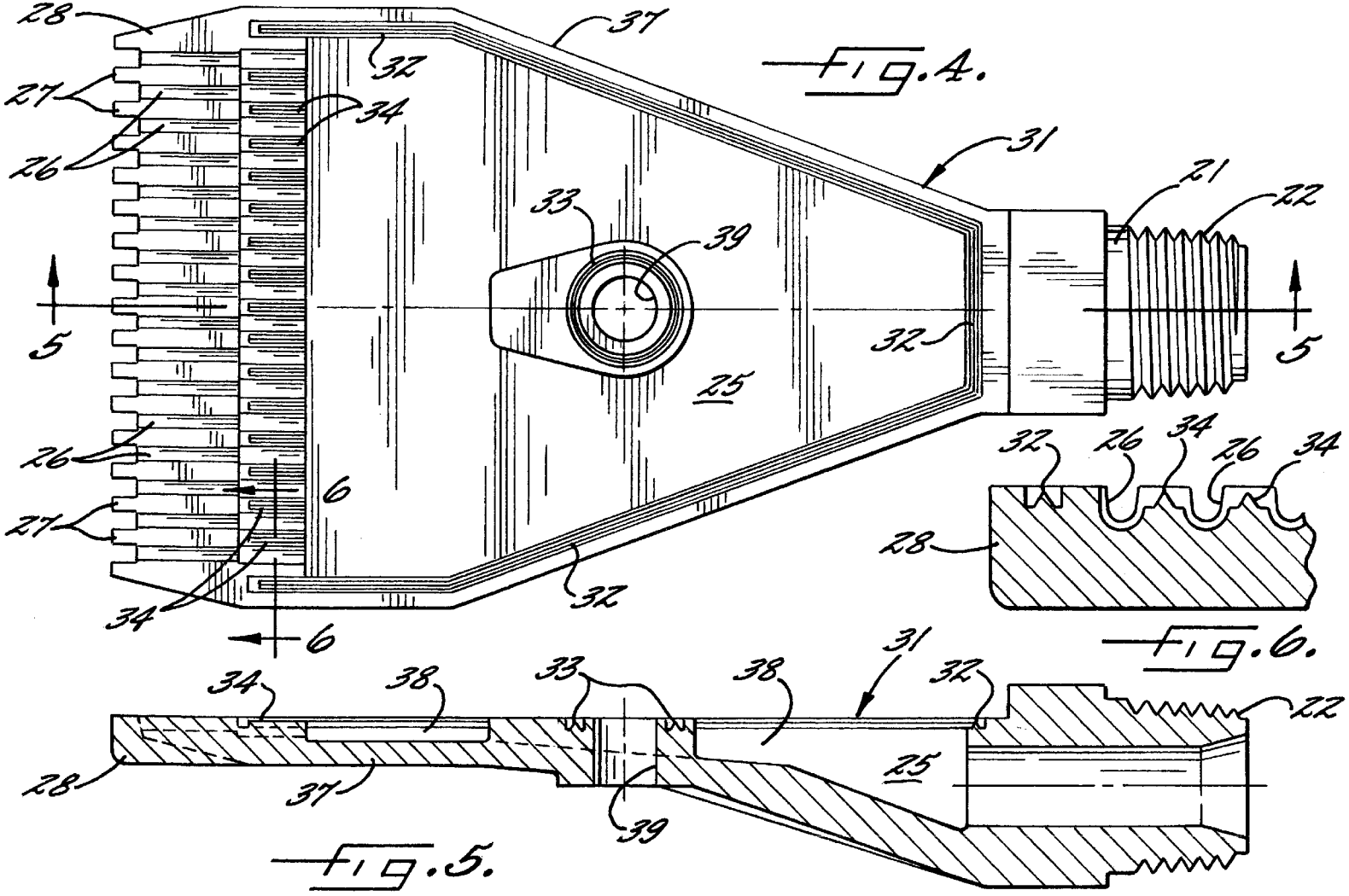
FIG. 4 is a top view of a first green component part used to prepare the fluid flow nozzle illustrated in FIG. 1.
FIG. 5 is a cross-sectional view taken in the plane of line 5—5 in FIG. 4.
FIG. 6 is an enlarged cross-sectional view taken in the plane of line 6—6 in FIG. 4.

The nozzle 20 is formed of a plurality of component parts which are connected to one another while still in the green state. In the illustrated embodiment, the nozzle 20 is formed from two component parts, namely first and second component parts 31, 41. The first component part 31, depicted in FIGS. 4–6 in a green state, comprises a body portion 37 formed with a recess 38 for defining a portion of the air chamber 25 in the finished nozzle and a bore 39 for defining a portion of the through bore 30 in the finished nozzle. The component part 31 further is defined by a perimeter or mating area 32 designed to mate with a complementary perimeter area of the second component part (shown in FIGS. 7–9 in the green state), as well as an annular bore mating area 39 and front mating areas 34.

Figures 7, 8, 9:
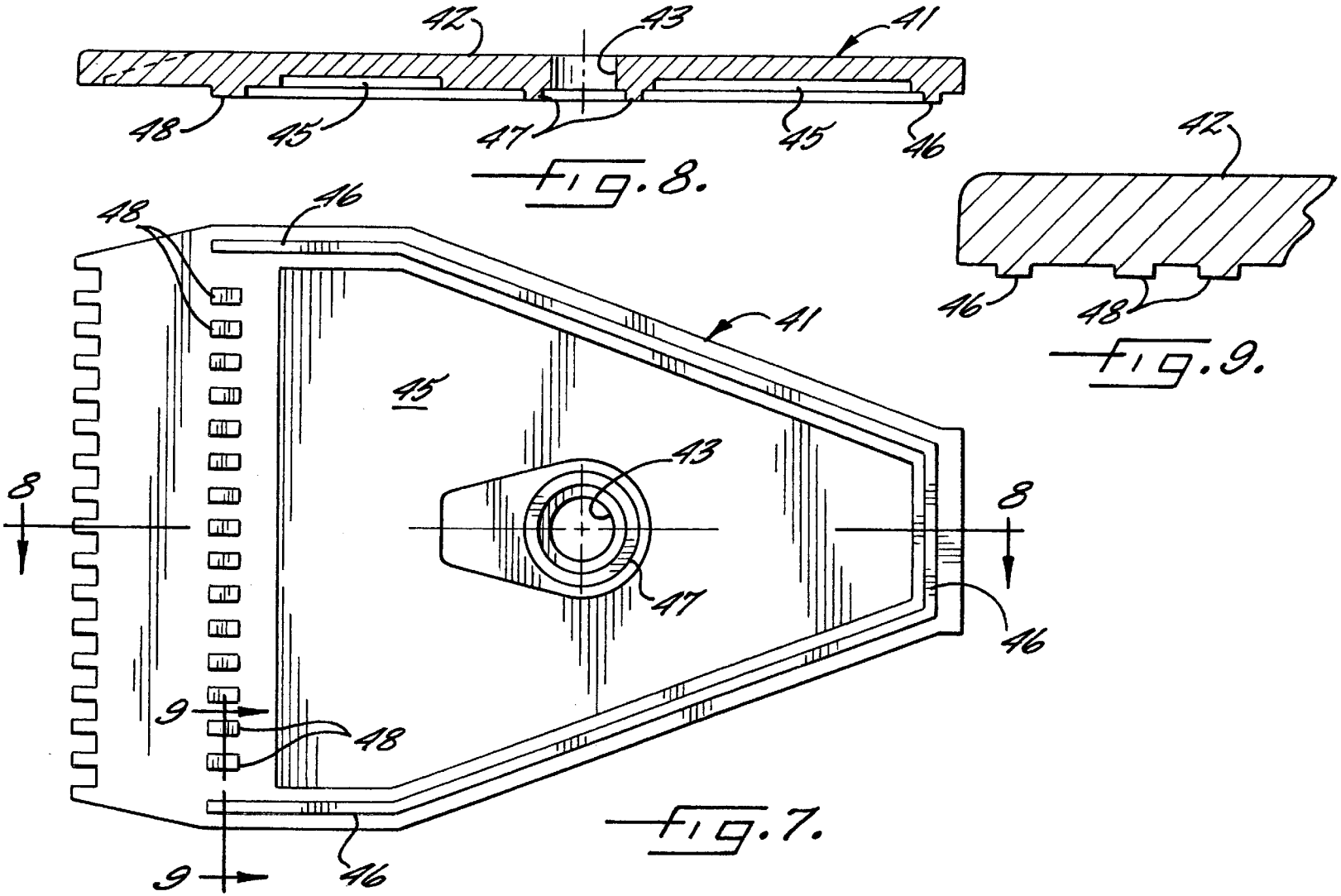
FIG. 7 is a bottom view of a second green component part used to prepare the fluid flow nozzle illustrated in FIG. 1.
FIG. 8 is a cross-sectional view taken in the plane of line 8—8 in FIG. 7.
FIG. 9 is an enlarged cross-sectional view taken in the plane of line 9—9 in FIG. 7.

The second component part 41, shown in a green state in FIGS. 7–9, includes a body portion 42 formed with a recess 45 for defining an opposing side of the air chamber 25 and a bore 43 designed to join with and communicate with the bore 39 in the upper component part. The second component part 41 further is formed with perimeter or mating areas 46, 47, 48 designed to mate with complementary perimeter areas of the first component part in forming the nozzle.

It will be appreciated that the component parts must be assembled and mated with a hermetic seal that prevents air from escaping through the seams between the parts in the finished nozzle when the nozzle is in use. The hermetic seal should be such as to prevent air or other fluid from escaping through the seams between the joined parts at the pressure expected to be encountered in service of the metal part. For example, for the illustrated fluid flow nozzle 20, the hermetic seal should be able to withstand air at a pressure of at least about 15 psig. Heretofore, in products made with such molded components, it has not been possible to achieve reliable hermetic seals with a strength sufficient to withstand such operating pressures.

In accordance with the invention, the green component parts are assembled together and ultrasonically welded along their mating surfaces in order to form a unitary green assembly, which is then debound and sintered to form a metal body having a hermetically sealed union at each of the ultrasonic junctures. In the illustrated embodiment, the component parts 31, 41 are ultrasonically welded along each of the mating surface areas, including the mating surface areas 32, 46 which surround and define the recesses, the mating areas 33, 47 which surround and define the bore portions, and the front mating areas 34, 48. Any suitable ultrasonic welding equipment, such as a Branson welder, may be used to create the welds. The welder may be operated under any welding conditions suitable for creation of the ultrasonic weld.

In keeping with the invention, the mating surface areas of at least one of the component parts are formed with energy directors, which cooperate with mating areas of the opposing component part to enhance the formation of ultrasonic welds between the parts during ultrasonic welding. In the illustrated embodiment, the first component part 31 includes a plurality of ultrasonic energy director surfaces, which, in the illustrated embodiment, constitute a perimeter rib 32, an annular rib 33 surrounding the bore 39, and a series of front ribs 34. As shown more particularly in FIGS. 5 and 6, each of the ribs preferably has a substantially triangular cross section, although those skilled in the art of ultrasonic welding will appreciate that such ribs may take any other suitable shape. The outwardly projecting flat surfaces 46, 47, and 48 of the second component part serve respectively as contact surfaces for the energy director surfaces 32, 33, 34 of the first component part 31.

Figure 10:
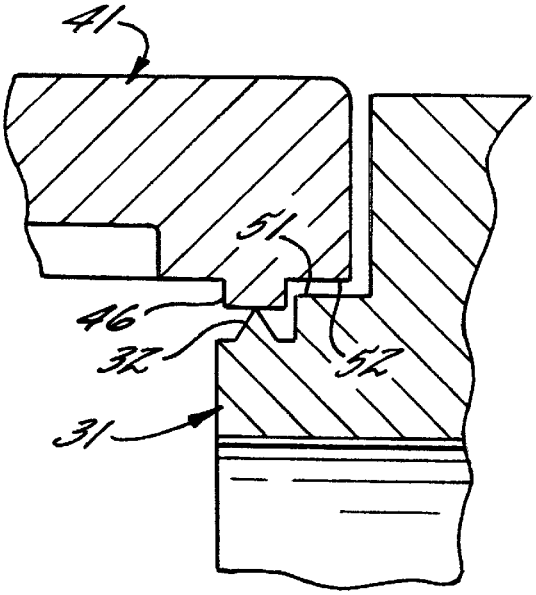
FIG. 10 is a cross-sectional view, in the region corresponding to region A of the metal body shown in FIG. 3, of the first green component part shown in FIGS. 4–6 and the second green component part shown in FIGS. 7–9 immediately prior to ultrasonically welding.
Figure 11:
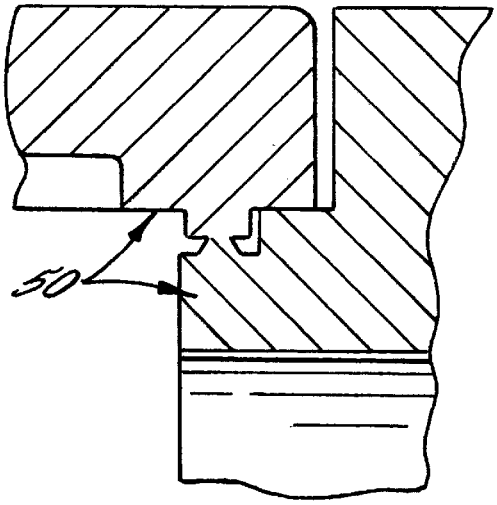
FIG. 11 is a cross-sectional view of a green assembly formed upon ultrasonically welding together the component parts shown in FIG. 10.
Figure 13:
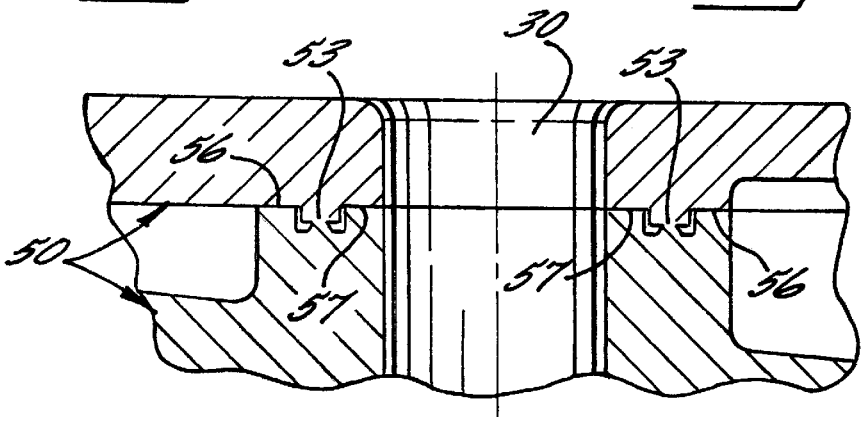
FIG. 13 is a cross-sectional view, in the region corresponding to region B of the metal body shown in FIG. 3, of the green assembly.
Figure 12:
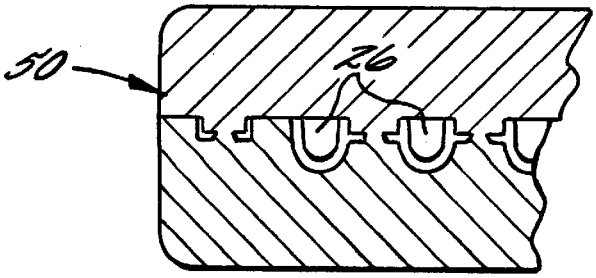
FIG. 12 is a cross-sectional view, corresponding to a section in the plane of line 12—12 of the metal body shown in FIG. 3, of the green assembly formed by ultrasonically welding the first and second component parts.

FIG. 10 illustrates the component parts 31, 41 placed together immediately prior to ultrasonic welding. As shown, the energy director surface (rib 32) is placed into engaging contact with the contact surface 46. Upon ultrasonically welding the parts to one another, the green assembly 50 (shown in FIG. 11) is formed. Other portions of the green assembly 50 are illustrated in FIGS. 12 and 13. The ultrasonically welded portions of the green body generally define a welded area, which may be defined as that portion of the contact surface on the part 41 that is taken up by the ultrasonic weld to the other component part 31.

In carrying out a further aspect of the invention, for enhancing the strength of the union between the component parts in the finished product, the mating areas of the component parts further have mutually engaging bonding surfaces which preferably are parallel and spaced apart when the energy director surface is placed into contact with the contact surface of the other component part. The ultrasonic welding of the parts to one another will cause deformation due to the melting of the material of the energy director surface. Thus, the bonding surfaces, exemplified by surfaces 51, 52 in FIG. 10, are brought into contact with or close proximity to one another once the first component part has been welded to the second component part to thereby define a green bonding area, or surface area of mutual contact or overlap. This green bonding area desirably is greater than the welded area defined by the ultrasonic weld, such that, when the green assembly is debound and sintered, the union of the component parts in the green bonding area is stronger than the union created by the ultrasonic weld. FIG. 13 illustrates another ultrasonic weld 53 and is adjacent bonding areas 56 and 57.

Figure 15:
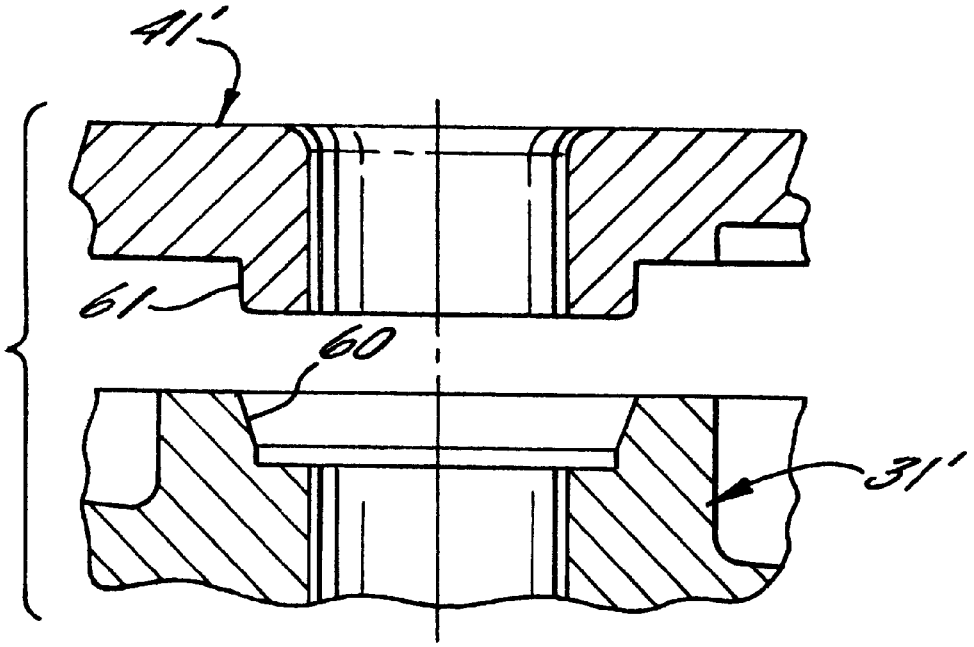
FIG. 15 is a cross-sectional view of the green component parts used to prepare the green assembly shown in FIG. 14.
Figure 14:
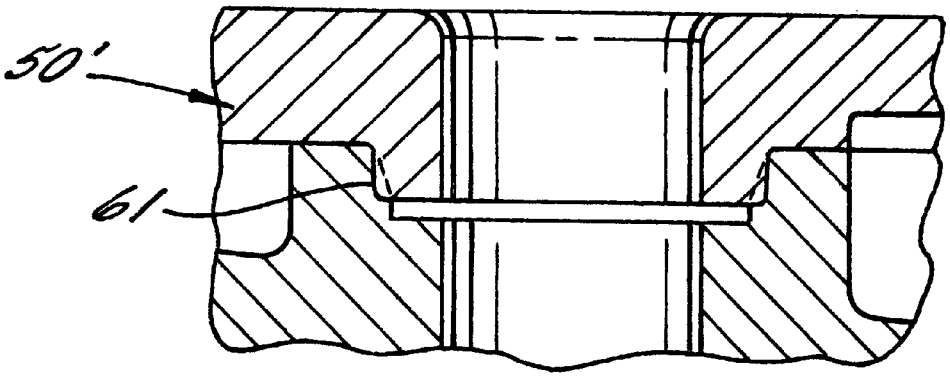
FIG. 14 is a cross-sectional view of an alternative embodiment of a green assembly formed by ultrasonically welding two green component parts.

FIGS. 14 and 15 illustrate an alternative embodiment of the invention. As shown in FIG. 15, component part 31' includes an interfering portion 60, which is defined by a wall portion that is sized to interfere with an engaging wall portion 61 of the mating component part 41'. The two component parts 31', 41' may be ultrasonically welded together to form the green assembly 50' illustrated in FIG. 14, with the interfering material of the interfering portion 60 being melted and deformed during the welding step.

In either embodiment of the invention, once the green body has been formed, it is debound and sintered in accordance with conventional metal powder molding techniques or other techniques that may be found suitable. For example, when the green assembly is formed from CATAMOLD® feedstock, the debinding of the green assembly may comprise catalytic debinding, alone or in conjunction with thermal debinding. After debinding of the green assembly, the debound green assembly then is sintered at a conventional or otherwise suitable temperature to form a metal body. Typically, the green assembly will shrink or otherwise deform during sintering, and thus the metal part ultimately obtained will be measurably smaller or differently shaped than the green assembly from which it was prepared.

Upon sintering, the metal body thus formed will be hermetically sealed along the ultrasonically welded junctures. With regard to the illustrated embodiment of the invention, the air chamber 25 of the nozzle 20 thus is substantially hermetically sealed, except at the air inlet and outlets where it is desired to allow the passage of air.

Thus, it is seen the invention provides a process that may be used to prepare hermetically sealed hollow metal bodies such as pressure vessels and fluid flow nozzles and fittings. It should further be appreciated that, while the present invention is particularly applicable to the preparation of metal bodies that have a hollow cavity, such as fluid flow nozzles and pressure vessels, it will be appreciated that the invention also is applicable to the preparation of other metal bodies.

What is claimed is:

1. A process for preparing a metal body, the process comprising the steps of:

providing a first green component part, said first component part comprising a molded metal powder material, said first component part having an ultrasonic energy director surface;

providing a second green component part, said second component part comprising a molded metal powder material;

placing said first and second component parts together with the energy director surface of said first component part being in contact with a contact surface of said second component part;

ultrasonically welding said first component part to said second component part to form an ultrasonic weld located at said contact surface of said second component part to thereby form a green assembly;

debinding said green assembly; and sintering said green assembly to thereby form a metal body, said metal body being hermetically sealed at said ultrasonic weld.

2. A process according to claim 1, said energy director surface comprising a rib having a generally triangular cross section.

3. A process according to claim 1, said energy director surface comprising an interfering portion defined by a wall portion sized to interfere with an engaging wall portion of said second component part.

4. A process according to claim 1, said first and second parts having mutually engaging bonding surfaces which define a green bonding area upon ultrasonically welding said first component part to said second component part.

5. A process according to claim 4, said weld defining a welded area, said green bonding area being greater than said welding area.

6. A process according to claim 1, wherein said debinding comprises thermal debinding.

7. A metal body prepared in accordance with the process of claim 1.

8. A process for preparing a metal body, the process comprising the steps of:

molding a first green component part from a metal powder molding material, said first green component part having an ultrasonic energy director surface;

molding a second green component part from a metal powder molding material;

placing said first and second component parts together with the energy director surface of said first component part being in contact with a contact surface of said second component part;

ultrasonically welding said first component part to said second component part to form an ultrasonic weld located at said contact surface of said second component part to thereby form a green assembly;

debinding said green assembly; and sintering said green assembly to thereby form a metal body, said metal body being hermetically sealed at said ultrasonic weld.

9. A process according to claim 8, said energy director surface comprising a rib having a generally triangular cross section.

10. A process according to claim 8, said energy director surface comprising an interfering portion defined by a wall portion sized to interfere with an engaging wall portion of said second component part.

11. A process according to claim 8, said first and second parts having mutually engaging bonding surfaces which define a green bonding area upon ultrasonically welding said first component part to said second component part.

12. A process according to claim 11, said weld defining a welded area, said green bonding area being greater than said welding area.

13. A process according to claim 7, wherein said debinding comprises thermal debinding.

14. A metal body prepared in accordance with the process of claim 8.

* * * * *